US009181764B2

(12) United States Patent
Hu

(10) Patent No.: US 9,181,764 B2
(45) Date of Patent: Nov. 10, 2015

(54) PIPE HANDLING APPARATUS

(71) Applicant: Honghua America, LLC, Houston, TX (US)

(72) Inventor: Guoqiang Hu, Houston, TX (US)

(73) Assignee: Honghua America, LLC, Houston, TX (US)

( * ) Notice: Subject to any disclaimer, the term of this patent is extended or adjusted under 35 U.S.C. 154(b) by 96 days.

(21) Appl. No.: 14/056,620

(22) Filed: Oct. 17, 2013

(65) Prior Publication Data

US 2014/0328650 A1 Nov. 6, 2014

Related U.S. Application Data

(60) Provisional application No. 61/819,342, filed on May 3, 2013.

(51) Int. Cl.
*E21B 19/14* (2006.01)
*E21B 19/20* (2006.01)

(52) U.S. Cl.
CPC ..... *E21B 19/14* (2013.01); *E21B 19/20* (2013.01)

(58) Field of Classification Search
CPC ..... E21B 15/00; E21B 19/14; E21B 19/20; G21C 19/16; G21C 19/10; G21C 19/105
USPC ..... 175/52, 85; 376/271; 414/22.51–22.59, 414/22.61–22.69, 22.71, 23, 24, 560, 561, 414/626, 718, 735, 745.1, 745.2, 745.3, 414/745.4; 901/8, 18
See application file for complete search history.

(56) References Cited

U.S. PATENT DOCUMENTS

| | | | | |
|---|---|---|---|---|
| 3,633,767 | A | 1/1972 | Mitchell et al. | |
| 3,990,591 | A * | 11/1976 | Street et al. | 414/561 |
| 4,013,178 | A | 3/1977 | Brown et al. | |
| 4,044,895 | A | 8/1977 | Adair | |
| 4,077,525 | A * | 3/1978 | Callegari et al. | 414/22.63 |
| 4,117,941 | A | 10/1978 | McCleskey, Jr. et al. | |
| 4,259,153 | A * | 3/1981 | Pryamilov et al. | 376/262 |
| 4,274,778 | A | 6/1981 | Putnam et al. | |
| 4,311,557 | A * | 1/1982 | Kowalski et al. | 376/271 |
| 4,345,864 | A | 8/1982 | Smith, Jr. et al. | |
| 4,462,733 | A * | 7/1984 | Langowski et al. | 414/22.71 |
| 4,610,315 | A * | 9/1986 | Koga et al. | 175/85 |
| 4,621,974 | A | 11/1986 | Krueger | |
| 5,183,122 | A | 2/1993 | Rowbotham et al. | |
| 5,787,137 | A * | 7/1998 | Nelson et al. | 376/249 |
| 6,298,927 | B1 * | 10/2001 | Back | 175/52 |
| 6,343,662 | B2 | 2/2002 | Byrt et al. | |
| 6,821,071 | B2 | 11/2004 | Woolslayer et al. | |
| 7,228,919 | B2 * | 6/2007 | Fehres et al. | 175/85 |
| 7,731,746 | B2 | 6/2010 | Kveen et al. | |
| 7,802,636 | B2 * | 9/2010 | Childers et al. | 175/52 |
| 2010/0143078 | A1 * | 6/2010 | Larkin | 414/22.51 |
| 2012/0020758 | A1 * | 1/2012 | Springett et al. | 414/22.63 |

FOREIGN PATENT DOCUMENTS

| | | | | |
|---|---|---|---|---|
| JP | 09137689 A * | 5/1997 | | E21B 19/20 |
| WO | WO 2011126844 A2 * | 10/2011 | | |

* cited by examiner

*Primary Examiner* — Gregory Adams
(74) *Attorney, Agent, or Firm* — Norton Rose Fulbright US LLP

(57) ABSTRACT

A pipe handling apparatus for handling pipe stands and stands of collars. The pipe handling apparatus improves the safety and efficiency of a rotary drilling operation. The pipe handling apparatus is integrated with a derrick monkey board, away from the heavy machinery within the derrick. The pipe handling apparatus is used for handling, storing and replacing pipe stands during the tripping out and tripping in processes.

7 Claims, 8 Drawing Sheets

PIPE HANDLING APPARATUS

CROSS REFERENCE TO RELATED APPLICATIONS

This application claims priority to U.S. Provisional Application No. 61/819,342, filed on May 3, 2013, which is hereby incorporated by reference in its entirety.

TECHNICAL FIELD

This invention relates to equipment used for rotary drilling operations for oil and gas wells. More specifically, this invention relates to an apparatus for handling pipe stands and stands of collars.

BACKGROUND

In an oil or gas drilling operation, the derrick is the support structure for the equipment used to lower and raise the drill string into and out of the wellbore. The drill string is a column of coupled drill pipes and drill collars that transmit torque and drilling fluid to the drill bit. Either a kelly drive or a top drive apparatus provides the torque to rotate the drill string and induce cutting and crushing of subterranean earth digging by the drill bit. Drill collars comprise the section of the drill string nearer the drill bit and are heavy, thick-walled tubes used between traditional drill pipe and the bit in the drill stem. The increased mass of the thicker collars provides increased downward force for the drill bit. As drilling depth increases, drill pipes are inserted between the derrick and the heavier drill collars.

The drill depth may reach many thousands of feet. Although the drill bit is made of hard materials, such as tungsten carbide, and continuously lubricated with drilling fluid, drill bit wear is inevitable. Consequently, the entire drill string must be removed several times during the drilling process to replace worn drill bits. The drill string may also be removed for replacing other equipment, running casing, or other reasons. The drill string removal and replacement process is known as "tripping pipe."

During the pipe tripping process, a portion of the drill string is pulled out of the well bore and up into the derrick. Drill pipes, typically about 30 ft in length, are removed in sections of coupled drill pipes called pipe stands. The number of drill pipes that comprise a pipe stand is governed by the height of the derrick. Pipe stands typically comprise 3 coupled drill pipes, but may comprise 2 or 4 coupled drill pipes. As the drill string is pulled out from the well bore, a pipe stand is threadably uncoupled from the drill string below. An uncoupled pipe stand is suspended by elevators attached to a drill line more than 90 ft. above the drill floor.

A typical five man drilling crew comprises two floorhands and a derrickman, who employ heavy equipment and physical strength to disassemble and reassemble a pipe string and temporarily store pipe stands during the tripping process. The lower portion of a pipe stand rests on one end of the drill floor called the setback area. The upper portion of a pipe stand is racked within the fingers of a racking board. In a concerted effort, the derrickman pulls the top of a suspended drill stand away from the well bore center line while a floorhand pushes the lower portion of the suspended pipe stand to the setback area. The drill line lowers the pipe stand onto the setback area of the pipe rack floor. The derrickman racks the upper portion of the drill stand within the racking board for temporary storage during the tripping process. The process is repeated until all the pipe stands and collars, often comprising a total of thousands of feet in length, have been removed. After replacement of the drill bit or other equipment, this process is reversed to reinsert all the pulled collars and pipe stands into the well bore to continue the drilling process.

The pipe tripping process is extremely dangerous. Rig personnel are working alongside heavy equipment and machinery capable of exerting exceedingly powerful forces. The derrickman works unaccompanied more than 90 ft above the drill floor. The drilling process usually continues for 24 hours a day, despite adverse weather conditions. Drilling mud, a viscous but slippery hydrated polysaccharide suspension, spills out of drill pipes, litters the drill floor and equipment, and obscures safety goggles. Human error, fatigue, extreme weather conditions, and chemical contaminants contribute to the dangers of pipe tripping. The International Association of Drilling Contractors (IADC) recognizes pipe tripping as the operation that involves the most lost-time and recordable injuries. The IADC recognizes drill pipes and collars as the equipment responsible for the most lost time after drilling rig accidents.

The drilling industry has attempted to address the dangers associated with personnel working on the drilling floor by developing mechanical pipe handling equipment.

U.S. Pat. No. 3,633,767 describes a pipe-racking apparatus employing a pantographic transfer arm that telescopes toward the well bore center line to retrieve pipe stands. U.S. Pat. No. 4,013,178 describes a pipe racker with a maneuverable arm that can pivot about an axis but requires an additional cable-lift system for handling drill collars. U.S. Pat. No. 4,044,895 describes a pipe racking apparatus comprising a pivotally mounted chute that positions single drill pipes, but not pipe stands, within a container. U.S. Pat. Nos. 4,117,941 and 4,274,778, and 4,621,974 describe devices for handling and racking drill pipes comprising upper and lower manipulators, requiring significant modification of upper and lower sections of the derrick. U.S. Pat. No. 4,345,864 descries a pipe stand moving apparatus having a gripping head mounted to a cantilever arm, but relies on several moving parts for operation including a worm gear, chains, drive sprockets, and other gears. U.S. Pat. No. 5,183,122 describes a derrick for raising or lowering drill string comprising a derrick frame, a rack, a gantry, and a pipe gripping unit. U.S. Pat. No. 6,343,662 describes a hydraulic drilling rig with a movable pipe support cradle that transfers pipe stands to a storage area. U.S. Pat. No. 6,821,071 describes an automated pipe racking apparatus with a rotatable arm support member that moves the top of a pipe stand and base grids mounted on the drill floor. U.S. Pat. No. 7,731,746 describes a pipe manipulator arm mounted to a rotatable assembly attached to the derrick.

The mechanical pipe handling equipment of the prior art includes integrated mechanisms for movement in forward, rear, up, and down directions and circular or rotational movement. The mechanical integration of the mechanisms responsible for movement in multiple directions requires complicated equipment that is difficult to service. There is a need in the art for a simple, compact, efficient, stable mechanical pipe handling apparatus that obviates the need for a derrickman and can be attached to an existing derrick. There is also a need in the art for a mechanical pipe handling apparatus that separates the mechanisms responsible for forward and rear, up and down, and rotational movement. While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

SUMMARY OF THE INVENTION

A pipe handling apparatus, comprises an extendable engaging arm, a crane, a pipe handler, and a racking board. The engaging arm extends from an engaging arm housing and retracts to a resting position within the engaging arm housing. The engaging arm comprises a gripper for gripping pipe stands and stands of collars. The crane comprises means for lateral and longitudinal displacement. The crane is attached to a pipe handler, and comprises means for rotating the pipe handler. The pipe handler is rotatably attached to the crane. The pipe handler comprises a pipe gripper and means for moving the pipe gripper vertically. The pipe handler is positionable at any coordinate within the monkey board. The pipe handler comprises an outer tube and an inner tube that is telescopable out from and into the outer tube in a substantially vertical direction. Each tube comprises an open face sufficiently large to allow a portion of a drill pipe or collar to pass through.

The pipe handling apparatus is integrated with a monkey board. The monkey board comprises a frame that extends outwardly substantially horizontally from a derrick to which it is attached. The pipe handling apparatus comprises separate mechanisms responsible for forward, rear, up, down, and rotational movement.

A method for handling pipe stands or stands of collars in a rotary drilling operation is described. The method comprises extending an engaging arm from an engaging arm housing, opening a grabber attached to the engaging arm, grabbing a pipe stand or stand of collars within a derrick with the grabber, retracting the engaging arm to position the pipe stand or stand of collars within a pipe handler at a Rotation Center position, gripping the pipe stand or stand of collars with a gripper attached to the pipe handler, opening the grabber to disengage the grabber from the pipe stand or stand of collars, retracting the engaging arm to a resting position within the engaging arm housing, rotating the pipe handler, moving the pipe stand or stand of collars to a desired location within a racking board, lowering the pipe stand or stand of collars, opening the gripper to release the pipe stand or stand of collars, and returning the pipe handler to a Rotation Center position.

DETAILED DESCRIPTION

Figure 1:
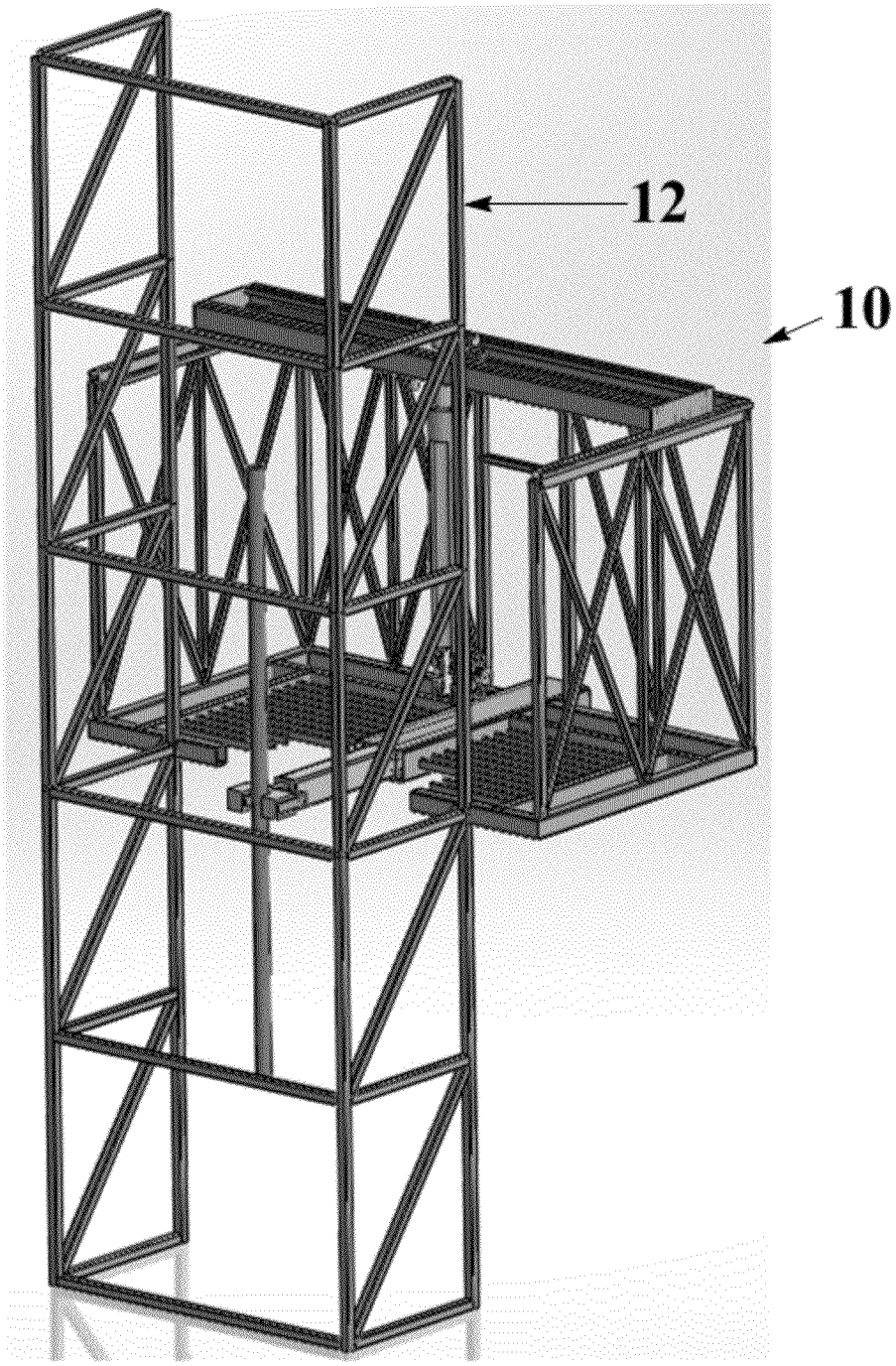
FIG. 1 displays the pipe handling apparatus attached to a section of derrick mast.
Figure 2:
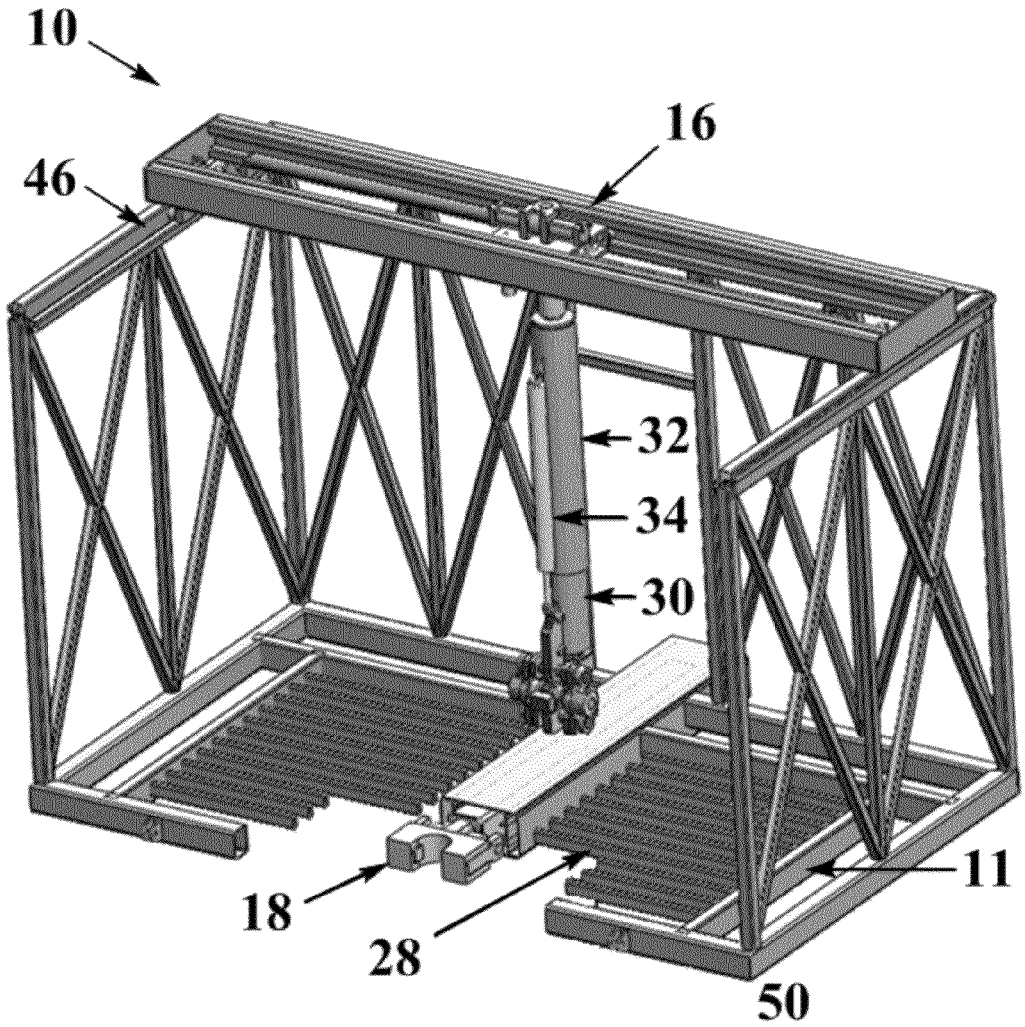
FIG. 2 displays the pipe handling apparatus with the derrick mast removed for clarity.
Figure 3:
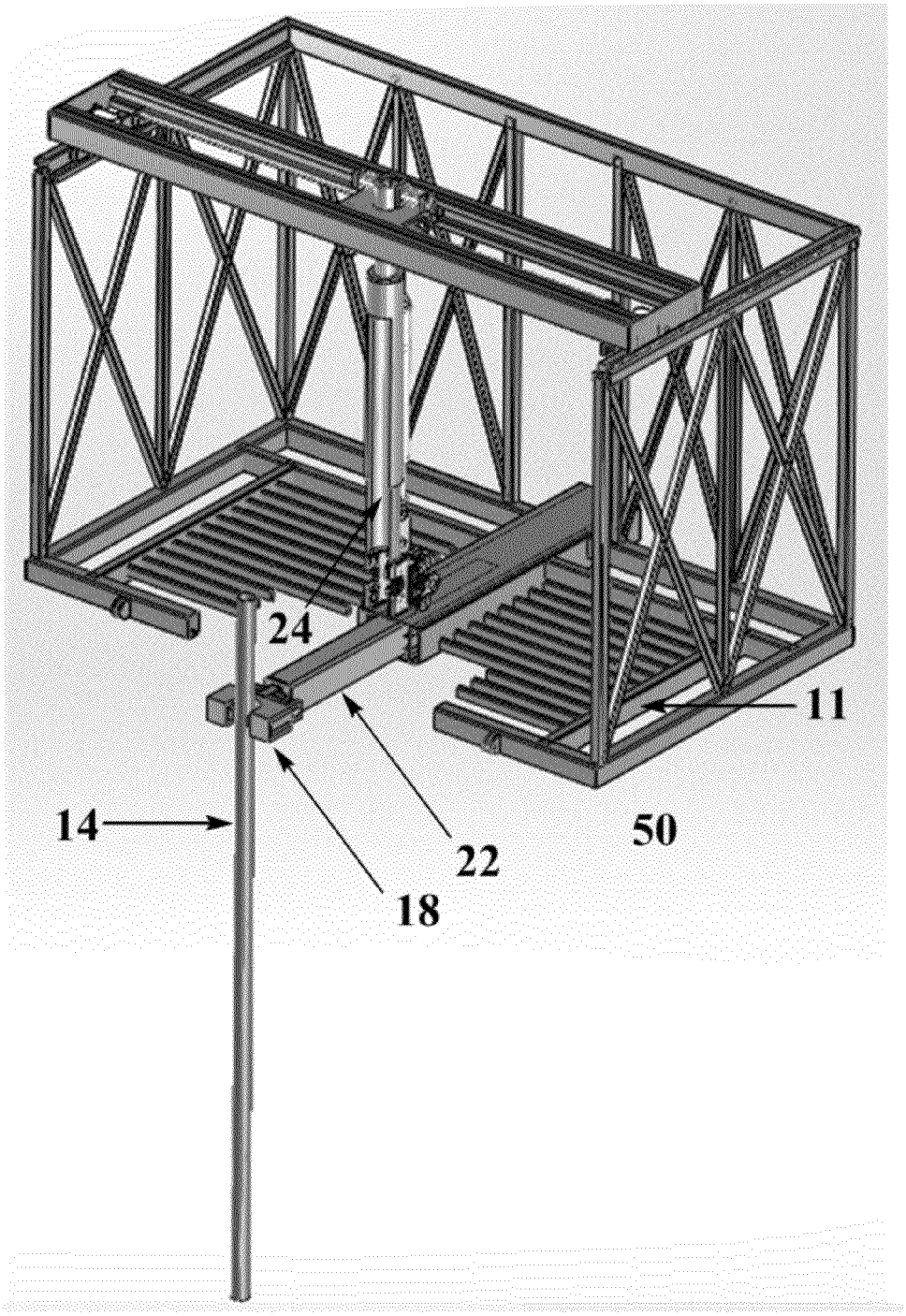
FIG. 3 shows the engaging arm extended and the grabber grabbing a pipe stand. The pipe handler is positioned with the open face facing the pipe stand.
Figure 4:
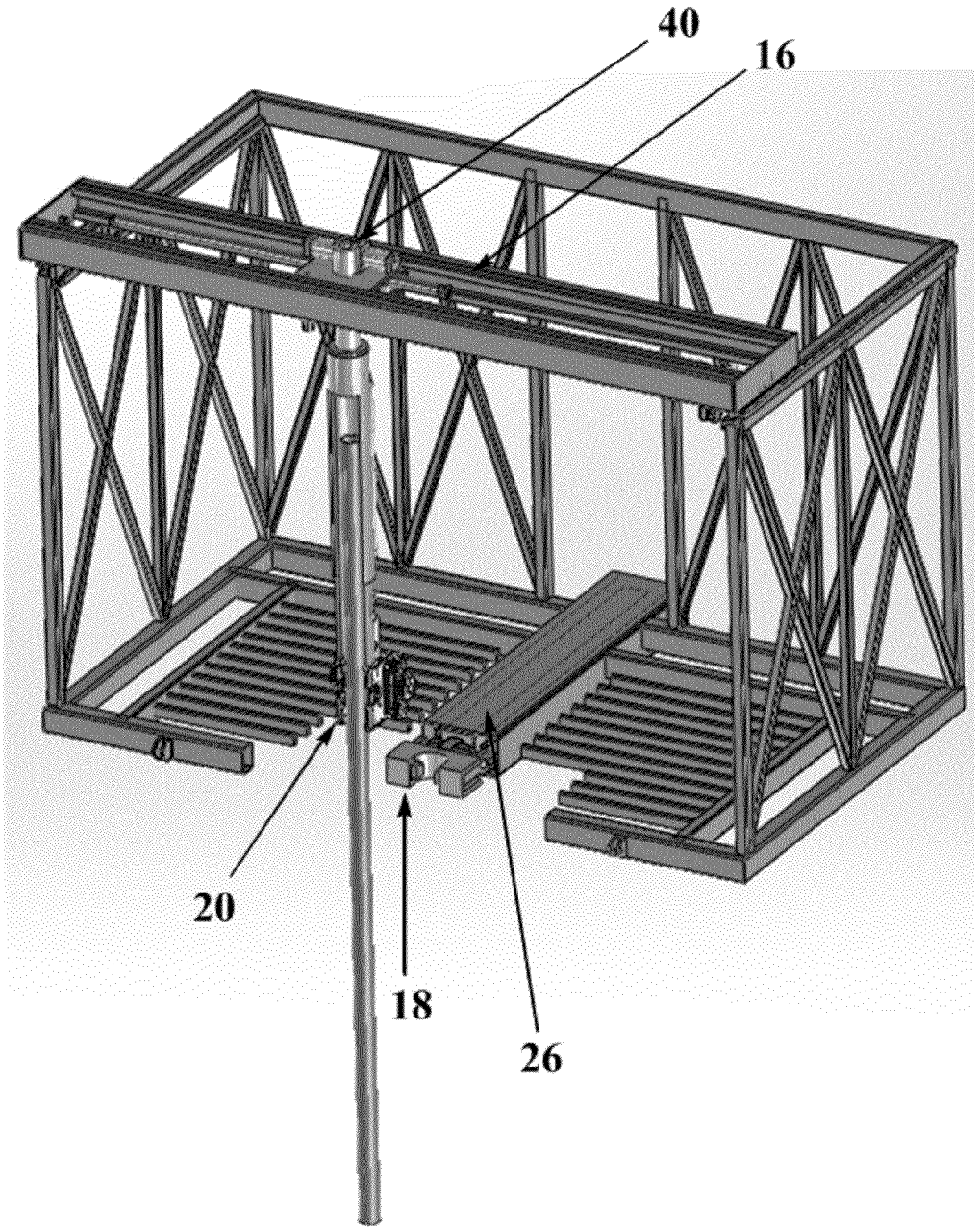
FIG. 4 shows the engaging arm fully retracted within the engaging arm housing and the pipe stand being gripped by the pipe handler gripper.
Figure 5:
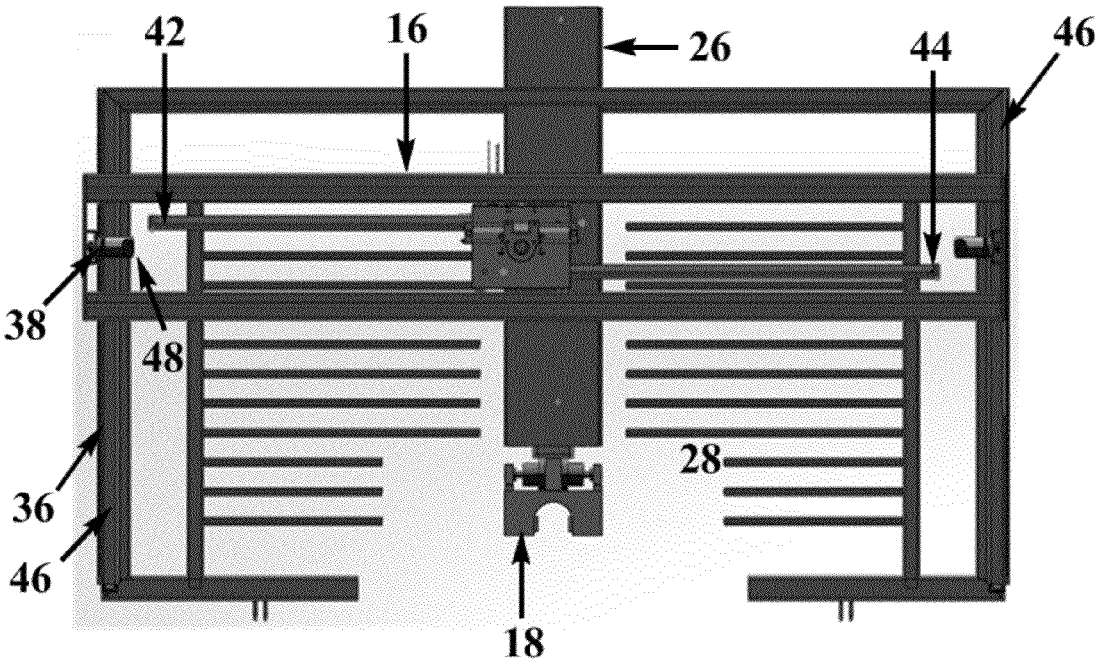
FIG. 5 is a top view of the pipe handling apparatus with the engaging arm fully retracted.
Figure 6:
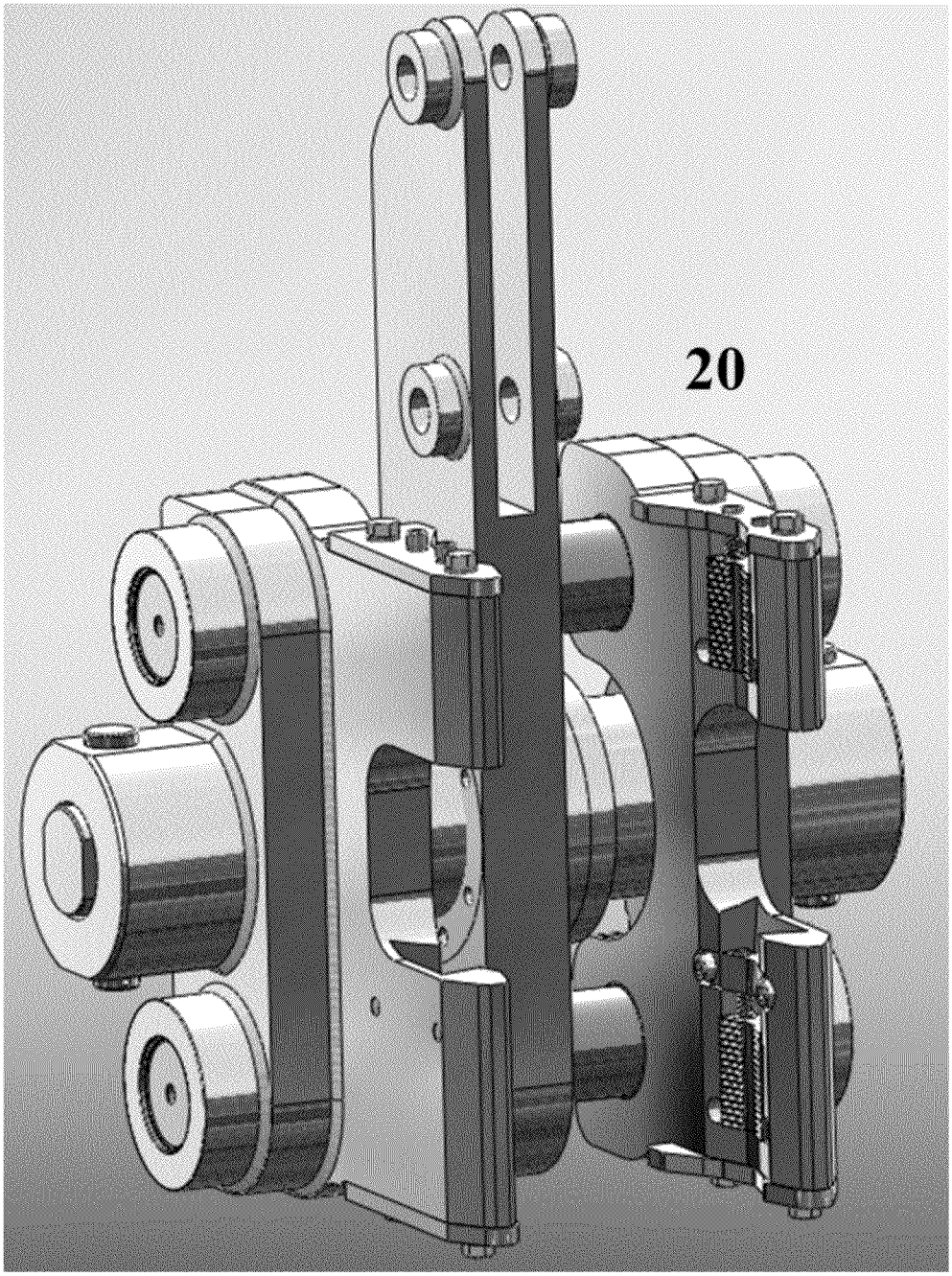
FIG. 6 is a schematic of the gripper.
Figure 7A:
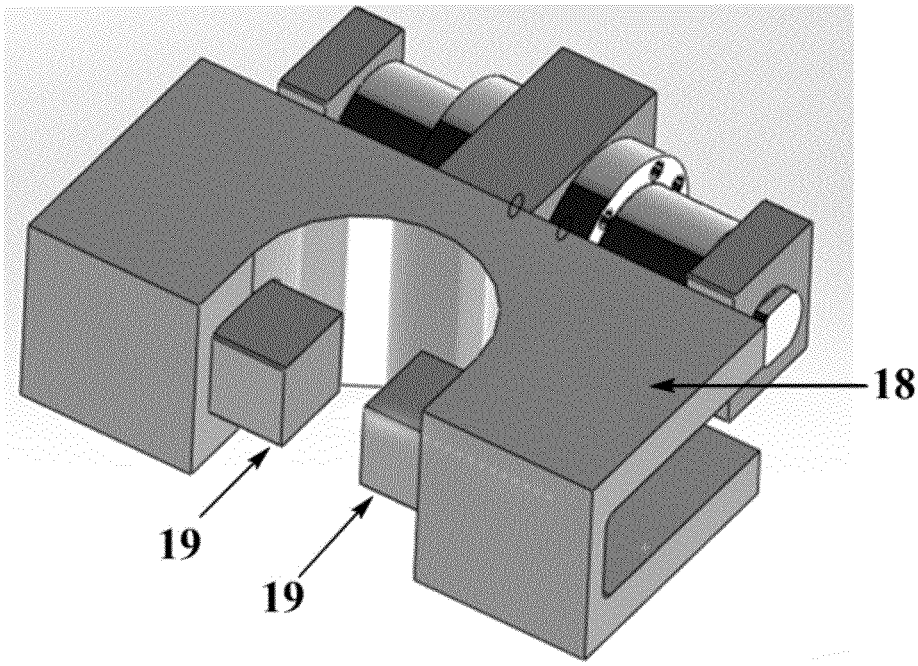
FIGS. 7A and 7B are schematics of the grabber and fingers.
Figure 7B:
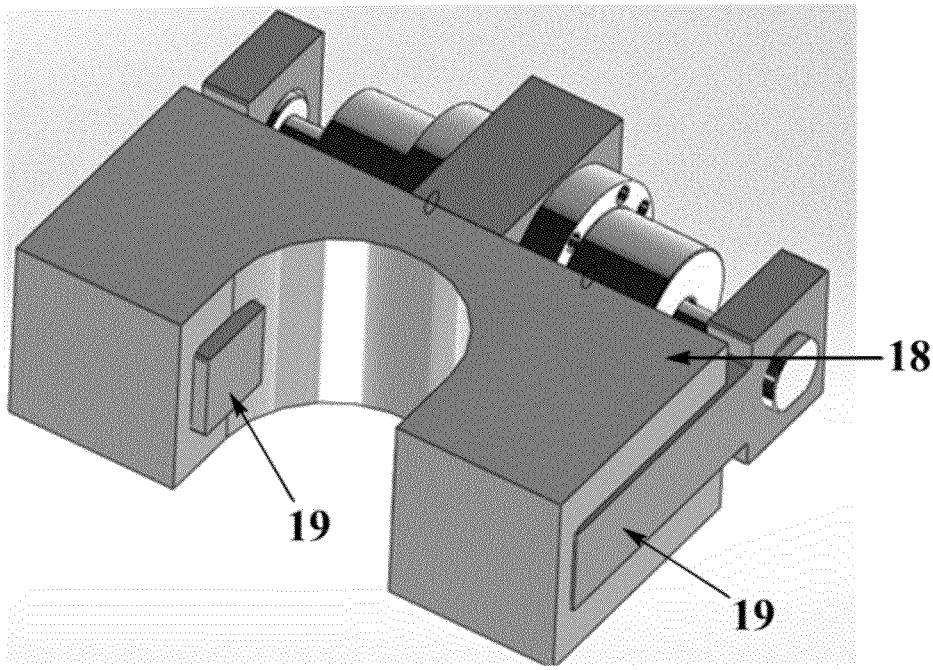
Figure 8:
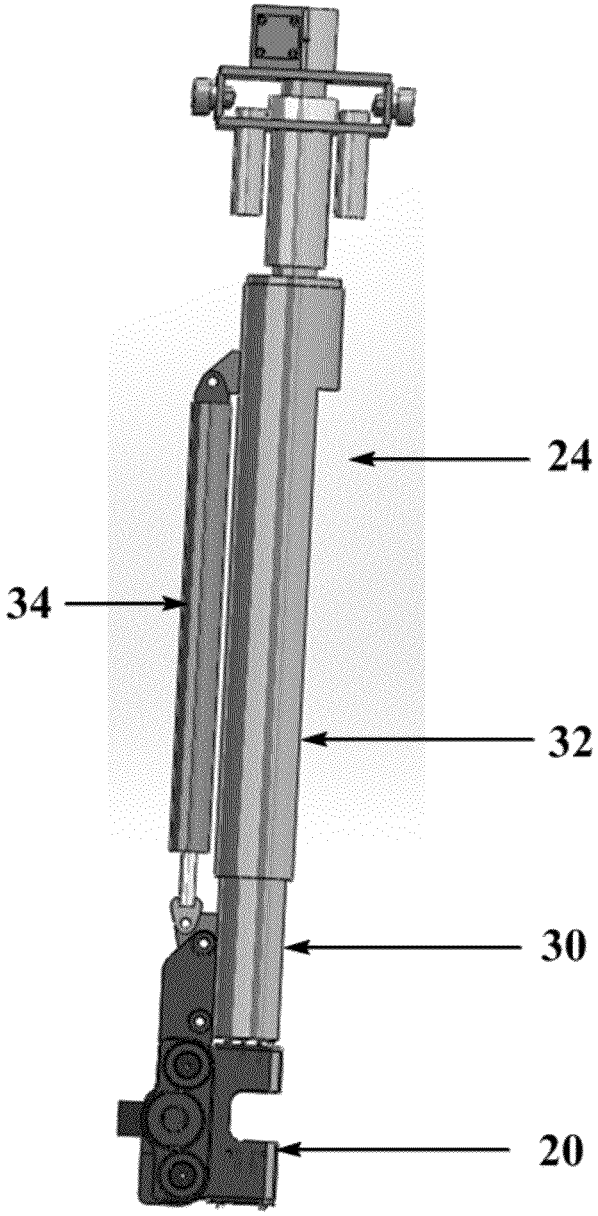
FIG. 8 is a side view of the pipe handler.

Various features and advantageous details are explained more fully with reference to the non-limiting embodiments that are illustrated in the accompanying drawings and detailed in the following description. It should be understood, however, that the detailed description and the specific examples, while indicating embodiments of the invention, are given by way of illustration only, and not by way of limitation. Various substitutions, modifications, additions, and/or rearrangements will become apparent to those of ordinary skill in the art from this disclosure.

In the following description, numerous specific details are provided to provide a thorough understanding of the disclosed embodiments. One of ordinary skill in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The pipe tripping process comprises extraction of the drill string from the well bore and repeated removal of pipe stands and stands of collars from the drill string and storage in the racking board, replacement of the drill bit or other equipment at the end of the drill string, and stepwise reassembly and reinsertion of the drill string into the well bore. Since the pipe handling procedure during the reinsertion of the drill string is substantially the reverse of the pipe stand removal, only the removal procedure will be described below.

With reference to the Figures wherein similar reference numbers denote corresponding parts in each view, the pipe handling apparatus 10 is integrated with the monkey board 11 and attached to the derrick 12 of an oil or gas drilling rig. Selected components of the derrick have been omitted for clarity. The monkey board 11 includes the sides, rear, and floor of the apparatus. The pipe handling apparatus comprises an engaging arm 22 housed within an engaging arm housing 26, and a pipe handler 24 rotatably coupled to a crane 16. The default position of the pipe handler 24 is Rotation Center (RC) in which the axis of rotation of the pipe handler is aligned with the center line of the engaging arm housing 26, the center line of the open face of the pipe handler 24 is facing the well bore axis, and the gripper 20 is fully open. The crane 16 includes independent mechanisms for travelling laterally and longitudinally. The longitudinal displacement of the crane 16 is controlled by a rack 36, pinion 38, and pinion motor 48, and the rack 36 is positioned along one or both upper longitudinal girders 46 of the monkey board 11. The lateral displacement of the crane 16 is controlled by dual, opposing horizontal hydraulic cylinders 42, 44. Lateral and longitudinal crane displacement may be concerted or independent.

In the pipe tripping removal process a pipe stand 14 is suspended above the well bore. The engaging arm 22 extends from the engaging arm housing 26 and towards the suspended pipe stand 14 with the grabber 18 in an open state. The grabber 18 includes fingers 19 that close to grab the pipe stand 14 and retract to release the pipe stand 14. The mechanism for closing and retracting the grabber fingers would be known to one of skill in the art. When the grabber reaches the pipe stand 14, the grabber 18 grabs and secures the pipe stand 14 above the well bore. The securement of the pipe stand 14 limits swaying of the lower portion of the pipe stand near the drill floor. Securement of the pipe stand 14 by the grabber 18, and subsequently by the gripper 20, obviate the need for supplemental support of the lower portion of the pipe stand near the drill floor. The engaging arm 22 retracts towards the engaging arm housing 26 until the upper portion of the pipe stand 14 is within the pipe handler 24 positioned at a Rotation Center (RC). The pipe handler gripper 20 grasps the pipe stand 14, and the grabber fingers 19 retract to disengage the grabber 18 from the pipe stand 14. The engaging arm 22 then retracts into the engaging arm housing 26.

The pipe apparatus rotary motor 40 rotates pipe handler 24 such that the open face is oriented towards the engaging arm grabber 18. In this orientation, an inadvertently dropped pipe stand 14 will fall towards the monkey board 11 and away from the heavy equipment inside the derrick 12. The lateral and longitudinal crane displacement mechanisms function to position the pipe stand 14 within the racking board 28. The horizontal hydraulic cylinders 42, 44 move the crane 16 laterally to a position where the rotational axis of the pipe handler 24 is aligned with the center of the gap between the rack board fingers and the engaging arm housing 26. The pinion motor 48 displaces the pipe handler 24 longitudinally until the pipe stand 14 has reached the appropriate rack position. The horizontal hydraulic cylinder 42 or 44 moves the pipe handler laterally along the gap between rack board fingers to the desired location. Vertical hydraulic cylinder 34 extends and inner tube 30 telescopes away from outer tube 32 to lower gripper 20 and pipe stand 14 until pipe stand 14 makes contact with the setback area on the drill floor. The gripper 20 opens and deposits the pipe stand 14 at the appropriate position within the racking board 28. The pipe handler 24 moves in a direction opposite the open face of the pipe handler to allow the gripper 20 and pipe handler 24 to move away from the pipe stand 14. The pipe handler 24 then returns to RC to await another pipe stand. In some embodiments, the pipe apparatus rotary motor 40 rotates pipe handler 24 before the pipe stand 14 is lowered onto the setback area to deposit a pipe stand.

The claims are not to be interpreted as including means-plus- or step-plus-function limitations, unless such a limitation is explicitly recited in a given claim using the phrase(s) "means for" or "step for," respectively.

What is claimed is:

1. A pipe handling apparatus, comprising an extendable engaging arm, said engaging arm extendable from an engaging arm housing, said engaging arm retractable to a resting position within said engaging arm housing, said engaging arm comprising a grabber for grabbing pipe stands and stands of collars;

a crane, said crane attached to a pipe handler, said crane comprising means for lateral and longitudinal displacement, said crane comprising means for rotating said pipe handler;

said pipe handler rotatably attached to said crane, said pipe handler comprising a pipe gripper, said pipe handler comprising means for moving pipe gripper vertically, said pipe handler positionable at any coordinate within a monkey board; and a racking board;

further comprising an outer tube and an inner tube, said inner tube telescopable out from and into said outer tube in a substantially vertical direction;

wherein the outer and inner tubes further comprise open faces sufficiently large to allow a portion of a drill pipe or collar to pass through.

2. The apparatus of claim 1, wherein the apparatus is integrated with the monkey board.

3. The monkey board of claim 2, further comprising a frame, wherein said frame extends outwardly substantially horizontally from a derrick to which it is attached.

4. The engaging arm of claim 1, said engaging arm extendable to position said grabber beyond said well bore center line.

5. The pipe handler of claim 1, said pipe handler rotatable 360 degrees.

6. A method for handling pipe stands or stands of collars in a rotary drilling operation, comprising extending an engaging arm from an engaging arm housing;

opening a grabber attached to said engaging arm;

grabbing a pipe stand or stand of collars within a derrick with said grabber;

providing a pipe handler comprising an outer tube and an inner tube and a gripper, wherein the steps of moving the gripper including vertically telescoping an inner tube out from and into an outer tube, and wherein outer and inner tubes further comprise open faces sufficiently large to allow a portion of a drill pipe or collar to pass through;

retracting said engaging arm to position said pipe stand or stand of collars within the pipe handler at a Rotation Center position;

gripping said pipe stand or stand of collars with the gripper;

opening said grabber to disengage said grabber from said pipe stand or stand of collars;

retracting said engaging arm to a resting position within said engaging arm housing;

rotating said pipe handler;

moving said pipe stand or stand of collars to a desired location within a racking board;

lowering the pipe stand or stand of collars;

opening the gripper to release the pipe stand or stand of collars; and returning the pipe handler to a Rotation Center position.

7. The method of claim 6, wherein during the steps of grabbing the pipe stand or stand of collars with a grabber attached to an engaging arm, retracting the engaging arm, gripping said pipe stand or stand of collars with a gripper attached to a pipe handler, opening the grabber to disengage the grabber from the pipe stand or stand of collars, retracting the engaging arm to a resting position within the engaging arm housing, rotating the pipe handler, and moving the pipe stand or stand of collars to a desired location within the racking board, the pipe stand or stand of collars is maintained at a constant height.

* * * * *